US009573185B2

(12) United States Patent
Wilson

(10) Patent No.: US 9,573,185 B2
(45) Date of Patent: Feb. 21, 2017

(54) APPARATUS AND METHOD FOR MOMENTUM-BALANCED FORGING

(71) Applicant: The Boeing Company, Chicago, IL (US)

(72) Inventor: Samuel D. Wilson, Everett, WA (US)

(73) Assignee: The Boeing Company, Chicago, IL (US)

( * ) Notice: Subject to any disclaimer, the term of this patent is extended or adjusted under 35 U.S.C. 154(b) by 191 days.

(21) Appl. No.: 13/941,021

(22) Filed: Jul. 12, 2013

(65) Prior Publication Data

US 2015/0013423 A1 Jan. 15, 2015

(51) Int. Cl.

| | |
|---|---|
| ***B21J 7/34*** | (2006.01) |
| ***B21J 5/00*** | (2006.01) |
| ***B21J 9/20*** | (2006.01) |
| ***B30B 11/02*** | (2006.01) |

(52) U.S. Cl.

CPC .. *B21J 5/00* (2013.01); *B21J 7/34* (2013.01); *B21J 9/20* (2013.01); *B30B 11/027* (2013.01)

(58) Field of Classification Search

CPC ..... B21J 5/00; B21J 5/02; B21J 7/20; B21J 7/28; B21J 7/34; B21J 7/40; B21J 7/46; B21J 9/12; B21J 9/20; B21J 5/025; B21J 7/04; B21J 7/22; B21J 7/24; B21J 9/02; B21J 9/10; B30B 11/027

USPC ..... 72/355.2, 355.4

See application file for complete search history.

(56) References Cited

U.S. PATENT DOCUMENTS

| | | | | |
|---|---|---|---|---|
| 3,271,991 | A * | 9/1966 | Monahan | B21J 7/24 72/407 |
| 3,429,174 | A * | 2/1969 | Fracke | B21J 7/34 100/264 |
| 3,488,990 | A * | 1/1970 | Brown | 72/407 |
| 3,707,866 | A * | 1/1973 | Brauer | B21J 7/24 72/407 |
| 3,822,579 | A * | 7/1974 | Kononenko | B21J 7/34 100/264 |
| 3,847,008 | A * | 11/1974 | Schmoll | B21J 7/34 100/264 |
| 3,898,834 | A * | 8/1975 | Kramer | 72/453.13 |
| 3,942,353 | A * | 3/1976 | Murek | 72/354.6 |
| 4,142,397 | A * | 3/1979 | Heimel | 72/407 |
| 4,191,045 | A * | 3/1980 | Stepantsov | B21J 7/34 72/407 |

(Continued)

FOREIGN PATENT DOCUMENTS

| | | |
|---|---|---|
| WO | WO 02/22289 | 3/2002 |
| WO | WO 03/061868 | 7/2003 |

OTHER PUBLICATIONS

International Search Report and Written Opinion, PCT/US2014/040996 (2014).

*Primary Examiner* — Edward Tolan

(74) *Attorney, Agent, or Firm* — Walters & Wasylyna LLC

(57) ABSTRACT

An apparatus for forging may include a moveable first tooling member configured to form a workpiece upon impact with the workpiece, a moveable second tooling member configured to form the workpiece upon impact with the workpiece, wherein the first tooling member and the second tooling member are each moveable relative to one another, and wherein a net momentum of a simultaneous impact with the workpiece by the first tooling member and the second tooling member is approximately zero.

25 Claims, 10 Drawing Sheets

(56) References Cited

U.S. PATENT DOCUMENTS

| | | | | |
|---|---|---|---|---|
| 4,208,895 | A * | 6/1980 | Grigorenko | B21J 9/20 100/289 |
| 4,914,938 | A | 4/1990 | Ishinaga | |
| 5,813,272 | A | 9/1998 | Gomi | |
| 5,894,752 | A * | 4/1999 | Yano | B21C 23/18 72/355.2 |
| 6,332,347 | B1 | 12/2001 | Gomi | |
| 6,698,267 | B1 * | 3/2004 | Olsson | 72/355.6 |
| 6,821,471 | B2 * | 11/2004 | Olsson | 264/293 |
| 2005/0220658 | A1 * | 10/2005 | Olsson et al. | 419/66 |
| 2005/0247092 | A1 | 11/2005 | Kirchhoff | |

* cited by examiner

APPARATUS AND METHOD FOR MOMENTUM-BALANCED FORGING

FIELD

The present disclosure is generally related to material forging and, more particularly, to an apparatus and method for momentum-balanced forging.

BACKGROUND

Various forging methods are known for shaping metal using localized compressive forces. Forging machines may utilize a very heavy hammer that travels along a linear path towards a very heavy anvil. A workpiece is placed upon the anvil and the hammer delivers an impact force to deform the workpiece. The forging hammer derives its power from the kinetic energy of the hammer in motion.

The mass of the hammer or the pressure applied to the hammer is an important factor in the forging process. Forging hammers typically may weigh between several hundred to several thousand pounds. Forging anvils must provide a solid base and may weigh up to thirty times the weight of the forging hammer.

Unfortunately, the large masses or pressures required for forging may result in the transmission of impact loads and vibrations to the forging machine frame and/or the floor. These loads may damage the floor or the machine frame and may impact the effectiveness of the forging process. As a result, forging machines require damper systems attached to the base of the forging machine to absorb and/or dissipate the impact loads and other energy resulting from the impact of the forging hammer.

Accordingly, those skilled in the art continue with research and development efforts in the field of material forging.

SUMMARY

In one embodiment, the disclosed apparatus for forging may include a machine frame, a first tooling member connected to the machine frame, the first tooling member being moveable relative to the machine frame, and a second tooling member connected to the machine frame opposite the first tooling member, the second tooling member being moveable relative to the machine frame, wherein the first tooling member and the second tooling member are configured to impact a workpiece positioned between the first tooling member and the second tooling member, and wherein the net momentum of the first and second tooling members is minimized.

In another embodiment, the disclosed apparatus for forging may include a moveable first tooling member configured to form a workpiece upon impact with the workpiece, a moveable second tooling member configured to form the workpiece upon impact with the workpiece, wherein the first tooling member and the second tooling member are each moveable relative to one another, and wherein a net momentum of a simultaneous impact with the workpiece by the first tooling member and the second tooling member is minimized (e.g., approximately zero).

In another embodiment, also disclosed is a method for forging, the method may include the steps of: (1) providing a workpiece to be formed, (2) providing a moveable first tooling member configured to form the workpiece upon impact with the workpiece and a moveable second tooling member configured to form the workpiece upon impact with the workpiece, the first tooling member and the second tooling member each being moveable relative to one another, (3) balancing a momentum of the first tooling member and the second tooling member such that a net momentum of a simultaneous impact with the workpiece by the first tooling member and the second tooling member is minimized (e.g., approximately zero), and (4) forming the workpiece in response to an impact force generated by the simultaneous impact with the workpiece by the first tooling member and the second tooling member.

Other embodiments of the disclosed apparatus and method for forging will become apparent from the following detailed description, the accompanying drawings and the appended claims.

DETAILED DESCRIPTION

Figure 1:
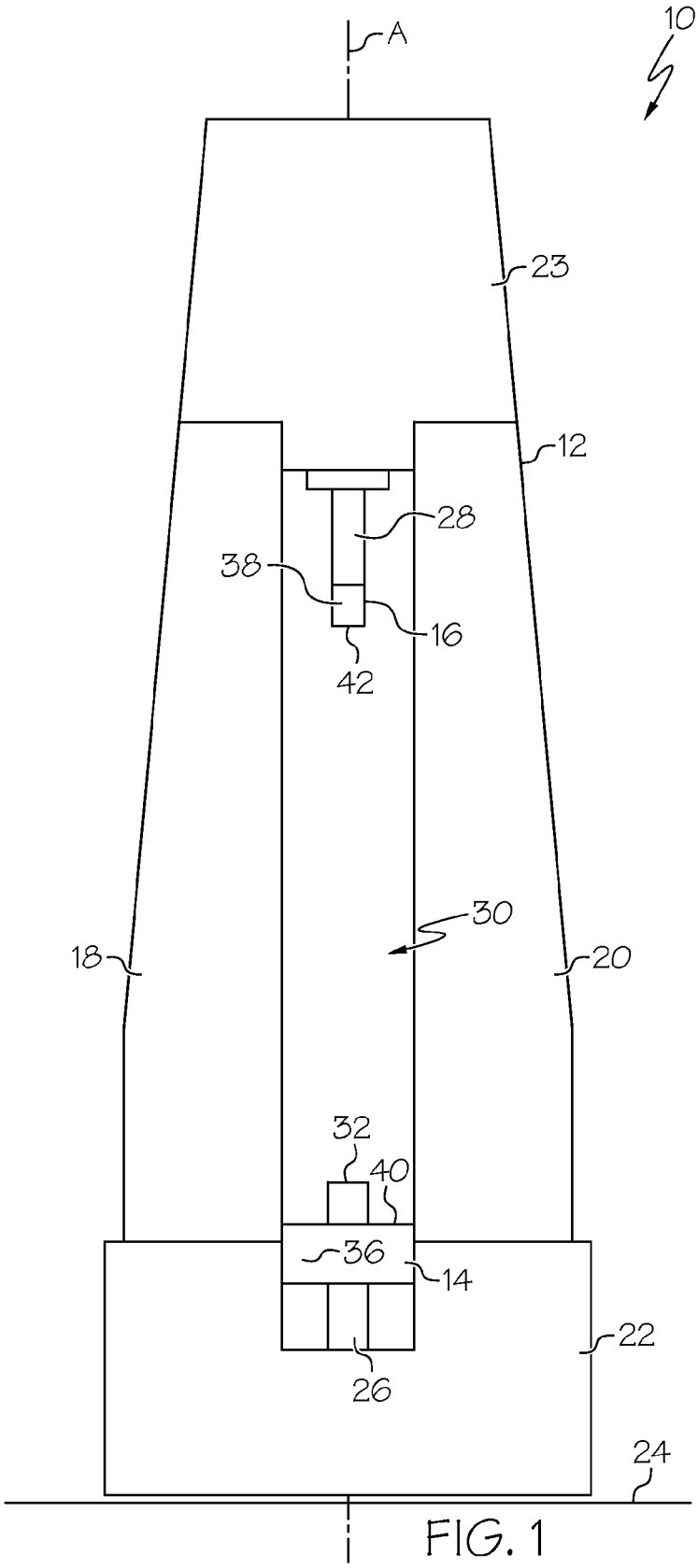
FIG. 1 is a front schematic view of one embodiment of the disclosed apparatus for forging.

The following detailed description refers to the accompanying drawings, which illustrate specific embodiments of the disclosure. Other embodiments having different structures and operations do not depart from the scope of the present disclosure. Like reference numerals may refer to the same element or component in the different drawings.

Figure 2:
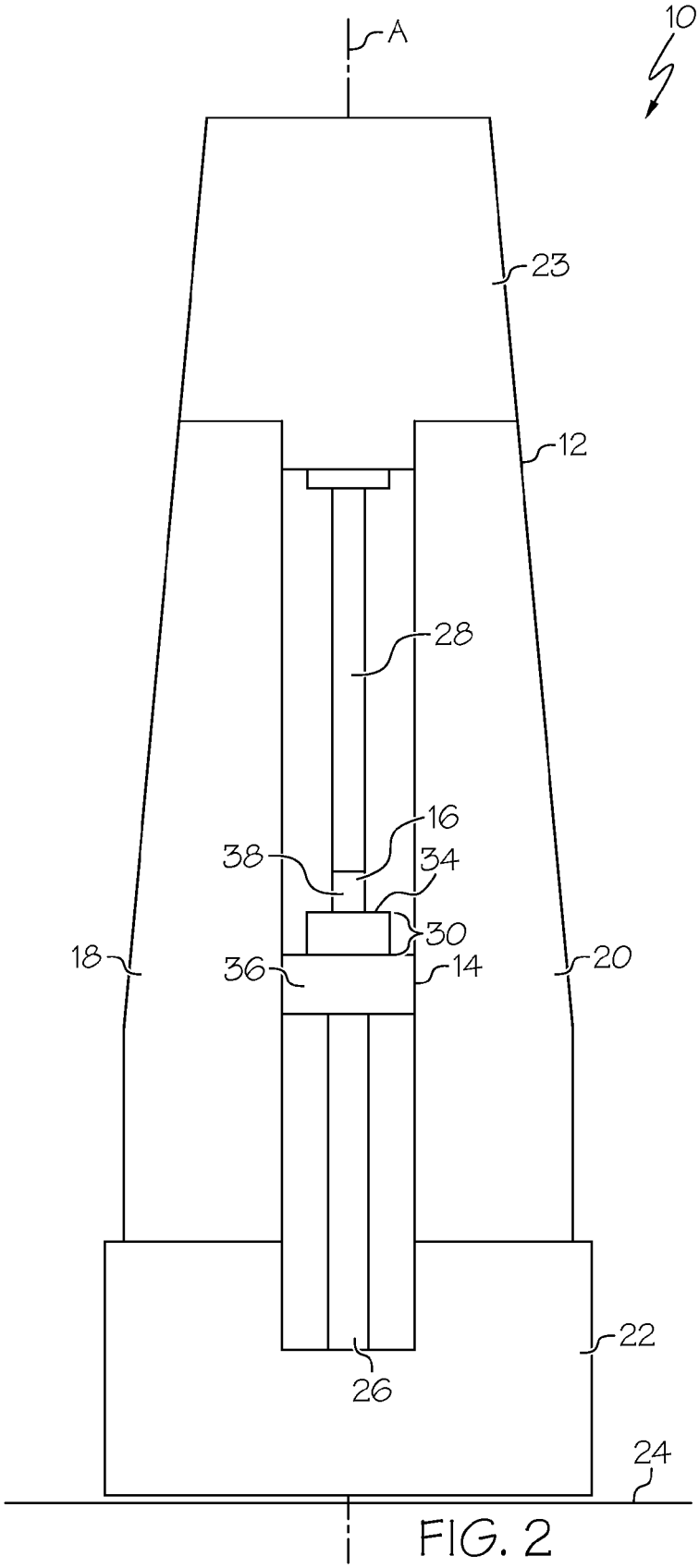
FIG. 2 is a front schematic view of the disclosed apparatus for forging of FIG. 1.

Referring to FIGS. 1 and 2, the disclosed apparatus for forging, generally designated 10, may include a machine frame 12, a first (e.g., lower) tooling member 14, and a second (e.g., upper) tooling member 16. Each of the first tooling member 14 and the second tooling member 16 may be moveable with respect to the frame 12. The disclosed apparatus for forging 10 may form a momentum-balanced system such that the net momentum following a forging impact is minimized (e.g., approximately zero).

The first tooling member 14 and the second tooling member 16 may be aligned (e.g., along a longitudinal axis A of the machine frame 12) and opposed to one another such that an impact force $F_I$ (FIG. 3) may be applied to a workpiece 32 positioned between the first tooling member 14 and the second tooling member 16 (e.g., at an impact zone 30). The impact force $F_I$ may be suitable to deform the workpiece 32 (e.g., create a desired geometric change to the material of the workpiece 32).

The workpiece 32 may be any formable or semi-formable material. For example the workpiece 32 may be a metallic material (e.g., a metal blank, a metal slug, metal billet, metal ingot, metal bloom, metal slab, or other metal workpiece). As another example, the workpiece 32 may be a non-metallic material (e.g., plastic, composite, or the like). The forging operation may be performed on a hot workpiece 32 (e.g., hot forging or hot working) or on a cold workpiece 32 (e.g., cold working or cold forging).

The machine frame 12 may support a first (e.g., lower) driving mechanism 26 and a second (e.g., upper) driving mechanism 28. The first driving mechanism 26 may be configured to move the first tooling member 14 toward the second tooling member 16 (e.g., upwardly). The second driving mechanism 28 may be configured to move the second tooling member 16 toward the first tooling member 14 (e.g., downwardly).

The machine frame 12 may include various structural components suitable to support the first tooling member 14, the first driving mechanism 26, the second tooling member 16, and the second driving mechanism 28 during a forging process. In one example construction, the machine frame 12 may include one or more substantially vertical frame members. For example, a pair of vertical frame members 18 and 20 may be disposed symmetrically with respect to a longitudinal axis A of the machine frame 12. The frame member 18, 20 may provide a guide (e.g., a linear guide) for motion of the first tooling member 14 and the second tooling member 16. In another example construction, the machine frame 12 may include horizontal frame members that facilitate movement of the first and second tooling members 14, 16 is a substantially horizontal direction.

Lower ends of the frame members 18, 20 may be rigidly connected to a base member 22. The first driving mechanism 26 may be housed within, connected to, or supported by the base member 22. The first drive mechanism 26 may be operably connected to the first tooling member 14. The base member 22 may be supported by a work surface 24 (e.g., factory floor). The base member 22 may be connected to the work surface 24 by any suitable connector or fastener mechanism.

Upper ends of the frame members 18, 20 may be rigidly connected to a cross member 23. The second driving mechanism 28 may be housed within, connected to, to supported by the cross member 23. The second drive mechanism 26 may be operably connected to the second tooling member 16.

The frame members 18, 20 may be made of any suitable rigid and durable material. However, as explained in more detail below, due to the near zero net momentum produced by the impact of the first tooling member 14 and the second tooling member 16, the structural components of the machine frame 12 may be constructed of considerably lighter weight materials than traditional heavy hammer forging machines.

During the forging process, the workpiece 32 may be positioned at the impact zone 30. The first tooling member 14 may be driven toward the impact zone 30 and the second tooling member 16. The second tooling member 16 may be driven toward the impact zone 30 and the first tooling member 14. Upon impact of the first tooling member 14 and the second tooling member 16 with the workpiece 32, the impact force $F_I$ (FIG. 3) may deform the workpiece 32.

Figure 3:
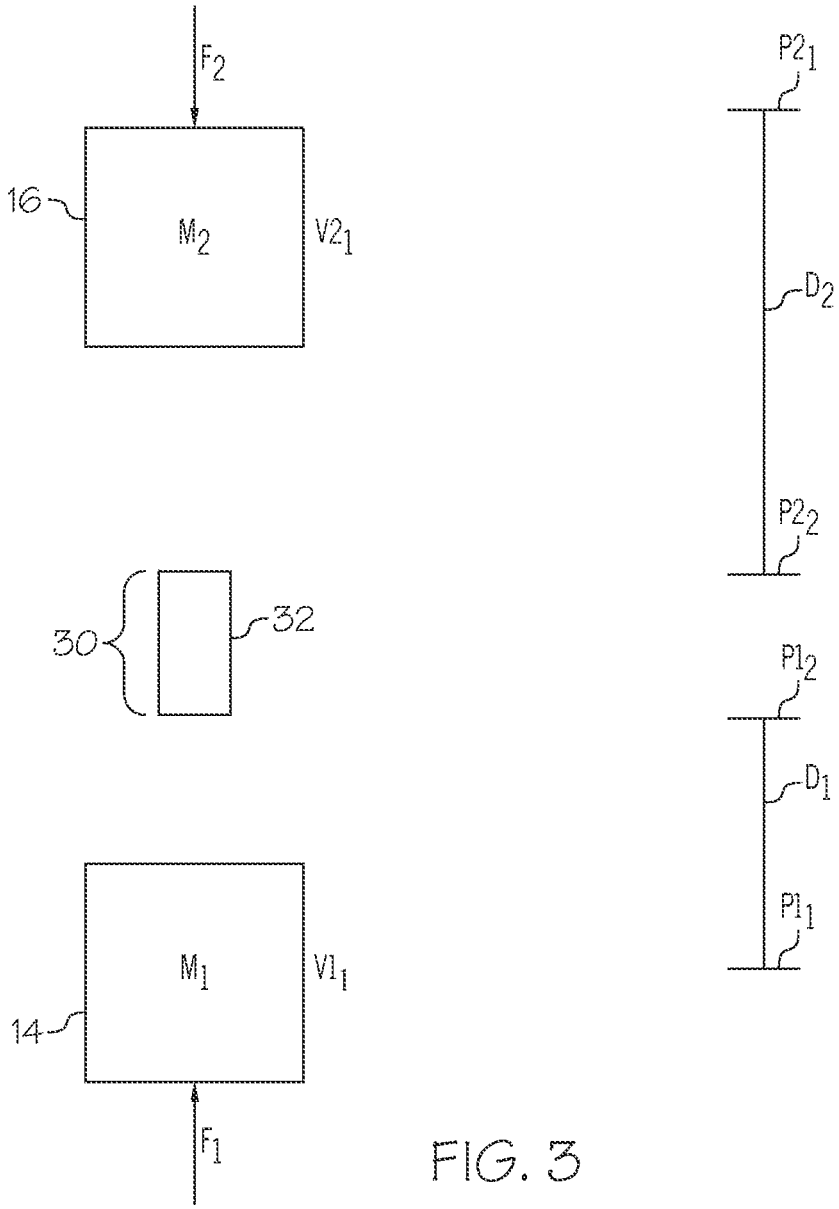
FIG. 3 is a schematic view of the tooling members of the disclosed apparatus for forging shown at an initial position.
Figure 4:
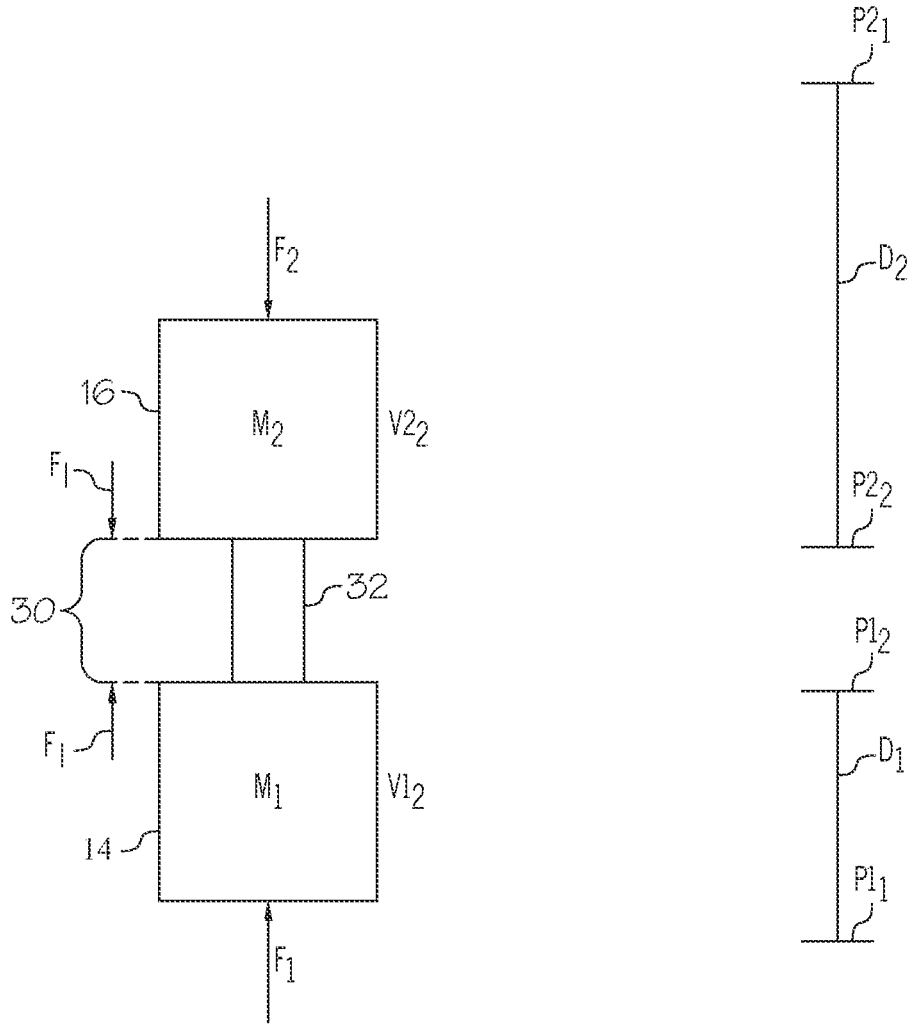
FIG. 4 is a schematic view of the tooling members of FIG. 3 shown at an impact position.
Figure 5:
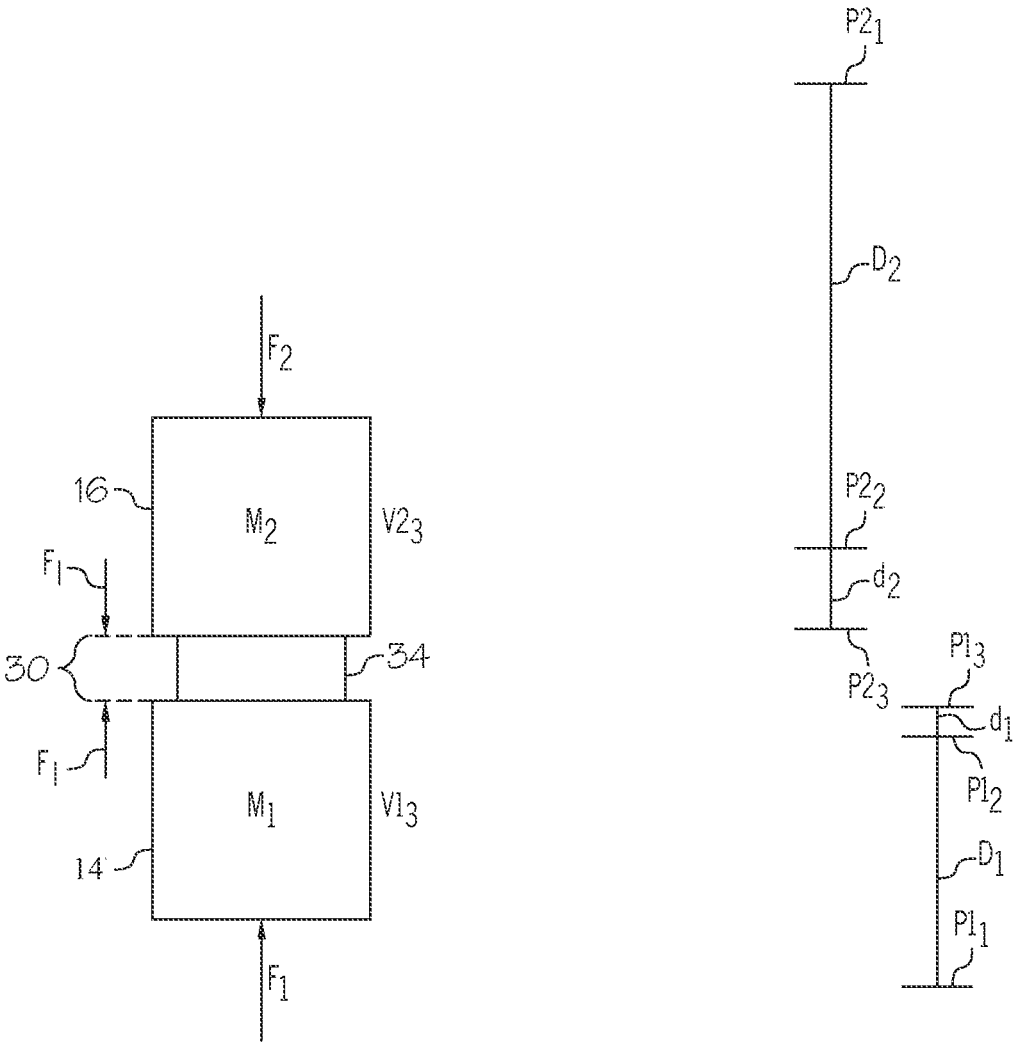
FIG. 5 is a schematic view of the tooling members of FIG. 3 shown at a final position.

Referring to FIGS. 3-5, the forging process may include a single impact or a plurality of impacts upon the workpiece 32. Each impact may be the result of one cycle of operation of the first tooling member 14 and the second tooling member 16. Each cycle may include a single drive stroke and a single return stroke of each of the first tooling member 14 and the second tooling member 16.

The first tooling member 14 may begin at a first initial position $P1_1$. The drive stroke of the first tooling member 14 may include movement from the first initial position $P1_1$, through a first impact position $P1_2$, and to a first final position $P1_3$ (FIG. 5). The second tooling member 16 may begin at a second initial position $P2_1$. The drive stroke of the second tooling member 16 may include movement from the second initial position $P2_1$, through a second impact position $P2_2$, and to a second final position $P2_3$ (FIG. 5).

The impact positions $P1_2$, $P2_2$ may be the respective locations of the tooling members 14, 16 at the instant of impact with the workpiece 32 (e.g., immediate before impact). The final positions $P1_3$, $P2_3$ (FIG. 5) may be the respective locations of the tooling members 14, 16 after work has been performed on the workpiece 32 (e.g., immediately after impact) and the workpiece 32 has been at least partially deformed.

The return stroke of the first tooling member 14 may include movement from the first final position $P1_3$ (FIG. 5) to the first initial position $P1_1$. The return stroke of the second tooling member 16 may include movement from the second final position $P2_3$ (FIG. 5) to the second initial position $P2_1$.

The first tooling member 14 may translate between the first initial position $P1_1$ and the first final position $P1_3$ (e.g., along the longitudinal axis A (FIG. 1) of the machine frame 12). The second tooling member 16 may translate between the second initial position $P2_1$ and the second final position $P2_3$ (e.g., along the longitudinal axis A of the machine frame 12).

The distance between the impact position $P1_2$ and the final position $P1_3$ of the first tooling member 14 and the impact position $P2_2$ and the final position $P2_3$ of the second tooling member 16 may define the impact zone 30. The impact zone 30 may be the location where work is performed on the workpiece 32 by the transfer of kinetic energy from the first tooling member 14 and the second tooling member 16 to the workpiece 32.

Still referring to FIGS. 3-5, the first tooling member 14 and any components that move with the first tooling member 14 may include a first mass $M_1$. The first driving mechanism 26 (FIGS. 1 and 2) may apply a first force $F_1$ to move the first tooling member 14 and any components that move with the first tooling member 14 (e.g., the first mass $M_1$). The first tooling member 14 may have a first initial velocity $V1_1$ (FIG. 3) at the first initial position $P1_1$, a first impact velocity $V1_2$ (FIG. 4) at the first impact position $P1_2$ (e.g., immediately before impact), and a first final velocity $V1_3$ (FIG. 5) at the first final position $P1_3$ (e.g., immediately after impact).

The second tooling member 16 and any components that move with the second tooling member 16 may include a second mass $M_2$. The second driving mechanism 28 may apply a second force $F_2$ to move the second tooling member 16 and any components that move with the second tooling member 16 (e.g., the second mass $M_2$). The second tooling member 16 may have a second initial velocity $V2_1$ (FIG. 3) at the second initial position $P2_1$, a second impact velocity $V2_2$ (FIG. 4) at the second impact position $P2_2$ (e.g., immediately before impact), and a second final velocity $V2_3$ (FIG. 5) at the second final position $P2_3$ (e.g., immediately after impact).

The first tooling member 14 may begin at rest (e.g., where the initial velocity $V1_1$ is zero at the initial position $P1_1$). The first tooling member 14 may move a first distance $D_1$ between the initial position $P1_1$ and the impact position $P1_2$.

The first force $F_1$ may be suitable for the first tooling member 14 to achieve the impact velocity $V1_2$ at the impact position $P1_2$. Upon impact, the first tooling member 14 may move a first distance $d_1$ between the impact position $P1_2$ and the final position $P1_3$ deforming the workpiece 32.

The second tooling member 16 may begin at rest (e.g., where the initial velocity $V2_1$ is zero at the initial position $P2_1$). The second tooling member 16 may move a second distance $D_2$ between the initial position $P2_1$ and the impact position $P2_2$. The second force $F_2$ may be suitable for the second tooling member 16 to achieve the impact velocity $V2_2$ at the impact position $P2_2$. Upon impact, the second tooling member 16 may move a second distance $d_2$ between the impact position $P2_2$ and the final position $P2_3$ deforming the workpiece 32.

The momentum of each of the first tooling member 14 and the second tooling member 16 may be determined by the following equation:

$$P=MV \quad \text{(Eqn. 1)}$$

wherein, P is the momentum of an object, M is the mass of the tooling member and any components that move with the tooling member, and V is the velocity of the tooling member and any components that move with the tooling member.

Thus, the equation for balanced-momentum at the instant of impact (e.g., the first tooling member 14 at the first impact position $P1_2$ and the second tooling member 16 at the second impact position $P2_2$) is:

$$M_1V1_2=M_2V2_2 \quad \text{(Eqn. 2)}$$

wherein, $M_1$ is the mass of the first tooling member 14 and any components that move with the first tooling member 14, $V1_2$ is the impact velocity of the first tooling member 14 and any components that move with the first tooling member 14 at the impact position $P1_2$, $M_2$ is the mass of the second tooling member 16 and any components that move with the second tooling member 16, and $V2_2$ is the impact velocity of the second tooling member 16 and any components that move with the second tooling member 16 at the impact position $P2_2$.

Momentum balancing of the first tooling member 14 and the second tooling member 16 at the instant of impact may allow for a significantly less robust machine frame 12. Further momentum balancing may reduce (if not eliminate) any loads and/or vibrations applied to the machine frame 12 and/or the work surface 24 as a result of the impact between the first tooling member 14 and the second tooling member 16 upon the workpiece 32 thus, reducing (if not eliminating) the need for damper systems connected between the machine frame 12 and the work surface 24.

At this point, those skilled in the art will appreciate that loads and/or vibrations may be minimized by zeroing the net momentum ($|M_1V1_2|-|M_2V2_2|=0$). However, advantage may still be gained by minimizing the net momentum, albeit not to zero. In one expression, the net momentum may be minimized by configuring the momentum ($M_1V1_2$) of the first tooling member 14 at the first impact position $P1_2$ to be within 20 percent of the momentum ($M_2V2_2$) of the second tooling member 16 at the second impact position $P2_2$. In another expression, the net momentum may be minimized by configuring the momentum ($M_1V1_2$) of the first tooling member 14 at the first impact position $P1_2$ to be within 10 percent of the momentum ($M_2V2_2$) of the second tooling member 16 at the second impact position $P2_2$. In yet another expression, the net momentum may be minimized by configuring the momentum ($M_1V1_2$) of the first tooling member 14 at the first impact position $P1_2$ to be within 5 percent of the momentum ($M_2V2_2$) of the second tooling member 16 at the second impact position $P2_2$.

The first tooling member 14 may be configured for operation with the design specifications of the apparatus for forging 10 and the workpiece 32. The first tooling member 14 may be suitably sized (e.g., dimensions and mass) to adequately support the size of the workpiece 32 (e.g., dimensions and mass). The apparatus for forging 10 may be designed based at least in part by the impact force $F_I$ (e.g., compression force) required to deform the workpiece 32 (e.g., create the desired geometric change to the material of the workpiece).

In an example construction, the first tooling member 14 may include a heavy member (e.g., having a large mass $M_1$ relative to the mass $M_2$ of the second tooling member 16) and may move at a relatively slow velocity (e.g., an impact velocity $V1_2$ significantly less than the impact velocity $V2_2$ of the second tooling member 16). The second tooling member 16 may include a relatively light member (e.g., having a small mass $M_2$ relative to the mass $M_1$ of the first tooling member 14) and may move at a very high velocity (e.g., an impact velocity $V2_2$ significantly greater than the impact velocity $V1_2$ of the first tooling member 14). As described above, the apparatus for forging 10 may be configured such that the first mass $M_1$ at impact velocity $V1_2$ is equal to the second mass $M_2$ at impact velocity $V2_2$ such that the momentum P at the instant of impact is balanced.

For example, the second mass $M_2$ of the second tooling member 16 may be between approximately 20 percent and 50 percent of the first mass $M_1$ of the first tooling member 14 and the impact velocity $V1_2$ of the first tooling member 14 may be between approximately 20 percent and 50 percent of the impact velocity $V2_2$ of the second tooling member 16.

As another example, the second mass $M_2$ of the second tooling member 16 may be between approximately 10 percent and 20 percent of the first mass $M_1$ of the first tooling member 14 and the impact velocity $V2_1$ of the first tooling member 14 may be between approximately 10 percent and 20 percent of the impact velocity $V2_2$ of the second tooling member 16.

As another example, the second mass $M_2$ of the second tooling member 16 may be between approximately 5 percent and 10 percent of the first mass $M_1$ of the first tooling member 14 and the impact velocity $V2_1$ of the first tooling member 14 may be between approximately 5 percent and 10 percent of the impact velocity $V2_2$ of the second tooling member 16.

As another example, the second mass $M_2$ of the second tooling member 16 may be less than 5 percent of the first mass $M_1$ of the first tooling member 14 and the impact velocity $V2_1$ of the first tooling member 14 may be less than 5 percent of the impact velocity $V2_2$ of the second tooling member 16.

As a specific non-limiting example, the first tooling member 14 may have a weight of 50 lbs. (mass $M_1$ of 22.68 kg) and an impact velocity $V1_2$ of 30 ft/s (9.14 m/s). The second tooling member 16 may have a weight of 5 lbs. (mass $M_2$ of 2.268 kg) and an impact velocity $V2_2$ of 300 ft/s (91.44 m/s).

As another specific non-limiting example, the first tooling member 14 may have a weight of 500 lbs. (mass $M_1$ 226.8 kg) and an impact velocity $V1_2$ of 10 ft/s (3.05 m/s). The second tooling member 16 may have a weight of 50 lbs. (mass $M_2$ 22.68 kg) and an impact velocity $V2_2$ of 100 ft/s (30.48 m/s).

Referring again to FIGS. 1 and 2, in an example embodiment, the disclosed apparatus for forging 10 may take the form of an open die forging-type machine. The first tooling member 14 may include a first die 36 (e.g., an anvil). The first die 36 may include a first die surface 40 configured to deform the workpiece 32 upon impact. The die surface 40 may be substantially flat, substantially concave, substantially convex, or a combination thereof. The second tooling member 16 may include a second die 38 (e.g., a hammer). The second die 38 may include a second die surface 42 configured to deform the workpiece 32 upon impact. The second die surface 42 may be substantially flat, substantially concave, substantially convex, or a combination thereof.

In an example implementation, as illustrated in FIG. 1, the workpiece 32 may be positioned upon the surface 40 of the first die 36 and moved toward the impact zone 30 with the first die 36. Thus, the first mass $M_1$ of the first tooling member 14 may include the mass of the first die 36 and the mass of the workpiece 32. As illustrated in FIG. 2, upon impact of the second die 38 with the workpiece 32, the impact force $F_I$ may deform the workpiece 32 (e.g., reducing the height of the workpiece 32 and increasing the width of the workpiece 32) into a fully or partially forged part 34.

In another example implementation, the workpiece 32 may be held in position at the impact zone 30. The workpiece 32 may be held in place by an external holding fixture (not shown). For example, the holding fixture may include an operator, a machine, or any other suitable holding fixture without limitation. Thus, the first mass $M_1$ of the first tooling member 14 may include only the mass of the first die 36. Upon impact of the first die 36 and the second die 38 with the workpiece 32, the impact force $F_I$ may deform the workpiece 32 into a fully or partially forged part 34.

Figure 6:
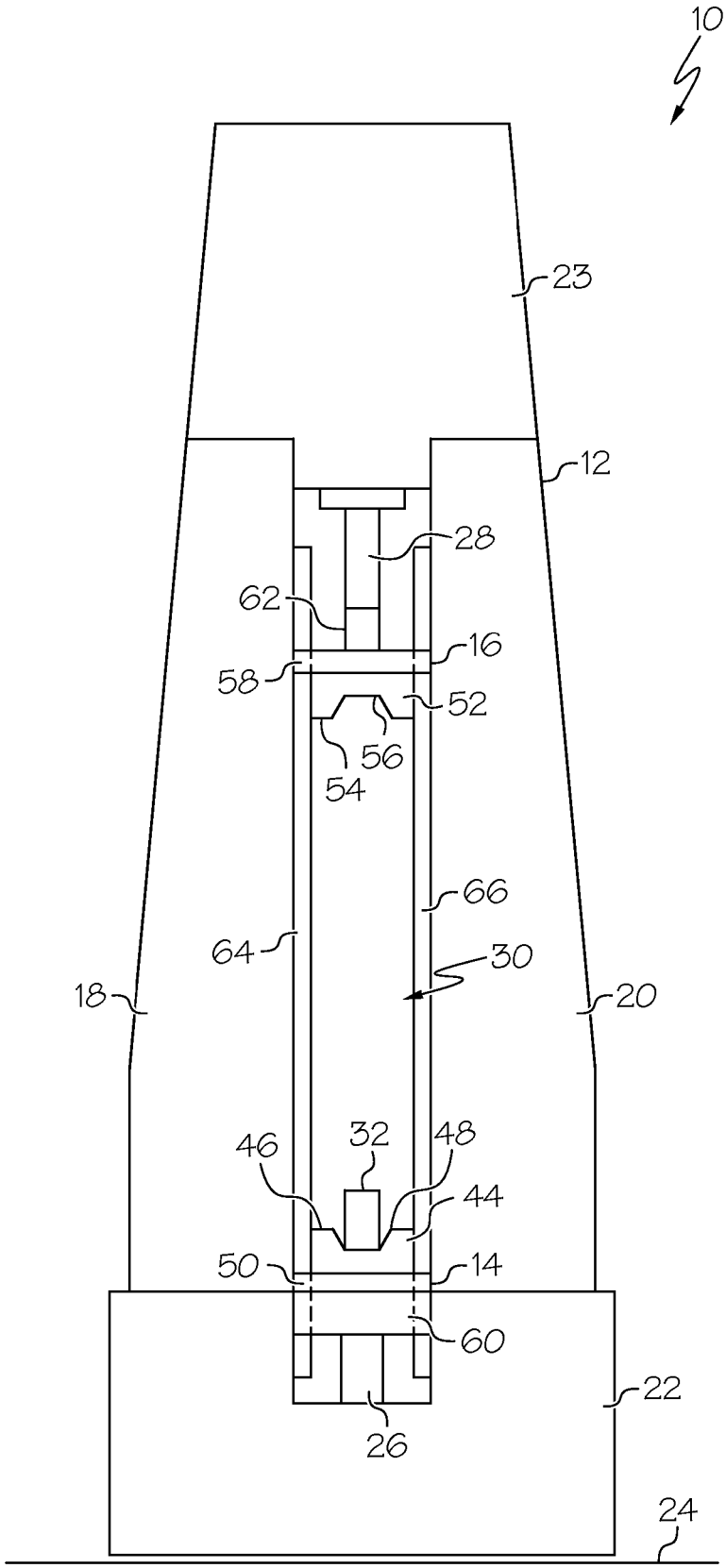
FIG. 6 is a front schematic view of another embodiment of the disclosed apparatus for forging.
Figure 7:
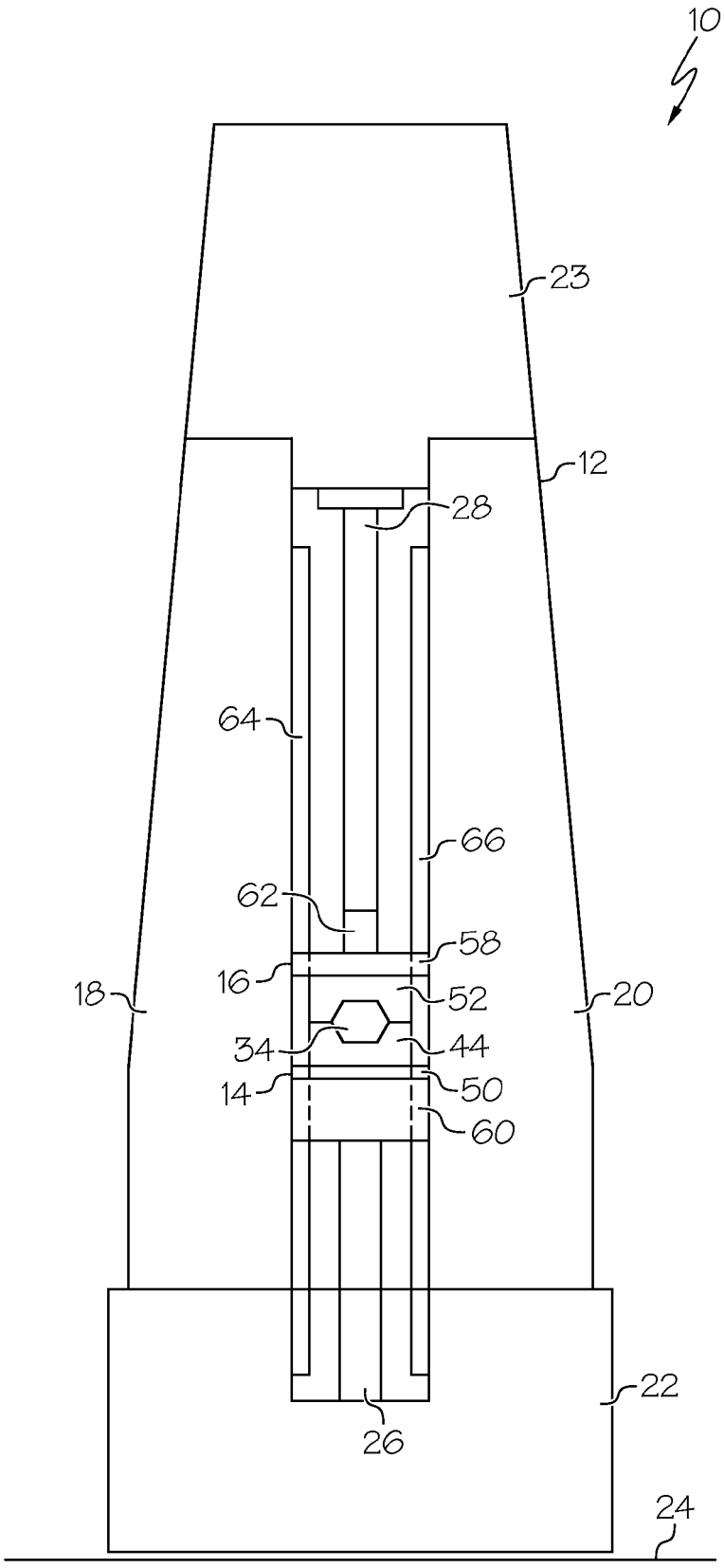
FIG. 7 is a front schematic view of the disclosed apparatus for forging of FIG. 6.

Referring to FIGS. 6 and 7, in another example embodiment, the disclosed apparatus for forging 10 may take the form of a closed die (e.g., impression die) forging-type machine. The first tooling member 14 may include a first die 44 (e.g., a mold). The first die 44 may include a first die surface 46 that defines at least one first cavity 48. The first tooling member 14 may include a first bolster plate 50 configured to securely hold the first die 44. The first die 44 may be rigidly connected (e.g., removably) or affixed (e.g., integrally) to the first bolster plate 50. For example, the first die 44 may be connected to the first bolster plate 50 by one or more mechanical fasteners (not shown). The fasteners may include any suitable mechanism configured to securely connect the first die 44 to the first bolster plate 50 including, but not limited to, bolts, clamps, brackets, pins, rails, or any other fastening means.

The first bolster plate 50 may be connected to secondary mass 60 of the first tooling member 14 (e.g., an anvil) that is operably connected directly to the first driving mechanism 26. Alternatively, the first bolster plate 50 may be operably connected directly to the first driving mechanism 26.

The second tooling member 16 may include a second die 52 (e.g., a mold). The second die 52 may include a second die surface 54 that defines at least one second cavity 56. The second tooling member 16 may include a second bolster plate 58 configured to securely hold the second die 52. The second die 52 may be rigidly connected (e.g., removably) or affixed (e.g., integrally) to the second bolster plate 58. For example, the second die 52 may be connected to the second bolster plate 58 by one or more mechanical fasteners (not shown). The fasteners may include any suitable mechanism configured to securely connect the second die 52 to the second bolster plate 58 including, but not limited to, bolts, clamps, brackets, pins, rails, or any other fastening means.

The second bolster plate 58 may be connected to secondary mass 62 of the second tooling member 16 (e.g., a hammer) that is operably connected directly to the second driving mechanism 28. Alternatively, the second bolster plate 58 may be operably connected directly to the second driving mechanism 28.

Optionally, the frame members 18, 20 may include a pair of linear guides 64, 66, respectively. A portion of the first tooling member 14 and/or the second tooling member 16 may engage the guides 64, 66 during the drive stroke and the return stroke. For example, the first bolster plate 50 and the second bolster plate 58 may each include channels configured to engage the guides 64, 66.

In an example implementation, as illustrated in FIG. 6, the workpiece 32 may be positioned with the cavity 48 of the first die 44 and moved toward the impact zone 30 with the first die 44. Thus, the first mass $M_1$ (FIG. 3) of the first tooling member 14 may include the mass of the first die 44, the mass of the first bolster plate 50, the mass of the workpiece 32, and optionally the mass of the secondary mass 60. As illustrated in FIG. 7, upon impact of the second die 52 with the workpiece 32 (FIG. 6), the impact force $F_I$ (FIG. 5) may deform the workpiece 32 (FIG. 6), such as by expanding the workpiece 32 within the combination of the first cavity 48 and the second cavity 56 (FIG. 6), thereby forming a fully or partially forged part 34.

In another example implementation, the workpiece 32 may be held in position at the impact zone 30. The workpiece 32 may be held in pace by an external holding fixture (not shown). For example, the holding fixture may include an operator, a machine, or any other suitable holding fixture without limitation. Thus, the first mass $M_1$ of the first tooling member 14 may include the mass of the first die 44, the mass of the first bolster plate 50, and optionally the mass of the secondary mass 60. Upon impact of the first die 44 and the second die 52 with the workpiece 32, the impact force $F_I$ may deform the workpiece 32 into a fully or partially forged part 34.

Those skilled in the art will appreciate that the first driving mechanism 26 and the second driving mechanism 28 may include any driving mechanism suitable to provide the respective driving forces $F_1$ and $F_2$ required to move the first tooling member 14 and the second tooling member 16 at respective impact velocities $V1_2$, $V2_2$ to achieve momentum balance. For example, the drive mechanisms 26, 28 may include, but are not limited to, mechanical drive mechanisms, pneumatic drive mechanisms, hydraulic drive mechanisms, combustion drive mechanisms, electromagnetic drive mechanisms, and the like.

Those skilled in the art will appreciate that the drive mechanisms 26, 28 may include various structural components configured to move (e.g., linearly) the tooling members 14, 16, respectively, through the drive stroke and/or the return stroke. For example, each of the drive mechanisms 26, 28 may include a pneumatic cylinder, a hydraulic cylinder, a combustion cylinder, or a motor configured to linearly translate the tooling members 14, 16. The drive mechanisms 26, 28 may include various other components, including, but not limited to, pumps, pistons, rods, valves, fittings, igniters, crankshafts and the like configured to apply the first force $F_1$ and the second force $F_2$ to the first tooling member 14 and the second tooling member 16, respectively.

In certain example constructions, depending upon the type of driving mechanism 26, 28 utilized, the apparatus for forging 10 may include one or more return mechanisms (not shown). The return mechanism may be connected between the machine frame 12 and the tooling member 14, 16. The return mechanism may be configured to return the tooling members 14, 16 back to the initial position $P1_1$, $P2_1$, respectively.

In an example implementation, the first drive mechanism 26 and the second drive mechanism 28 may be substantially the same type of drive mechanism. In another example implementation, the first drive mechanism 26 and the second drive mechanism 28 may be different types of drive mechanisms.

Figure 8:
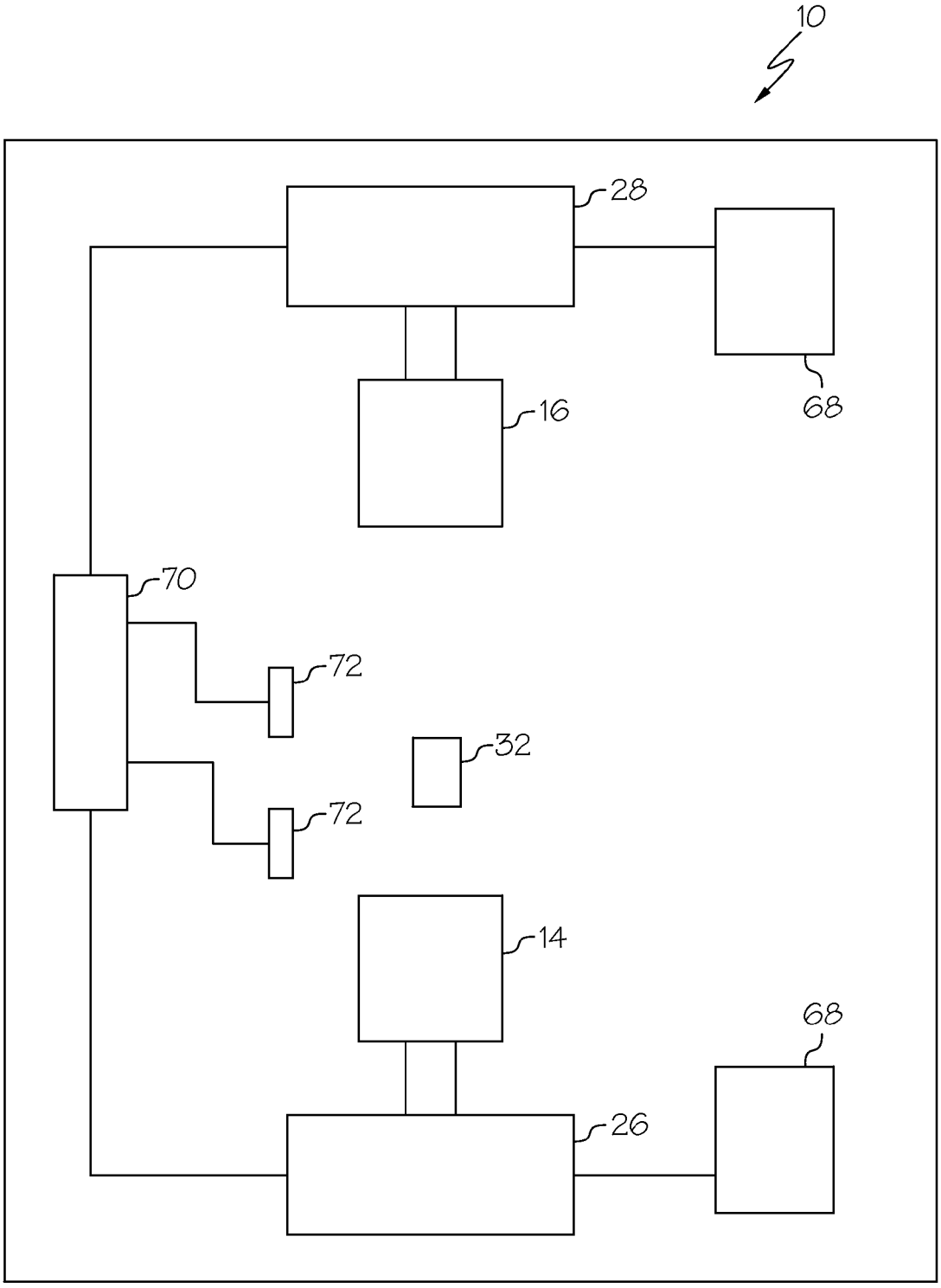
FIG. 8 is a schematic view of another embodiment of the disclosed apparatus for forging.

Referring to FIG. 8, the apparatus for forging 10 may include at least one energy source 68 connected to the first driving mechanism 26 and the second driving mechanism 28. The energy source 68 may provide power to the driving mechanisms 26, 28 to generate the first force $F_1$ and the second force $F_2$, respectively (FIG. 4). For example, the energy source 68 may supply electricity to a pump for a pneumatic or hydraulic drive mechanism or a motor for a mechanical drive mechanism. As another example, the energy source 68 may supply fuel to a combustion drive mechanism.

Each driving mechanism 26, 28 may share a single energy source 68 or each driving mechanism 26, 28 may be connected to its own energy source 68. For example, if the first drive mechanism 26 and the second drive mechanism 28 are substantially the same type of drive mechanism, each driving mechanism 26, 28 may share a single energy source 68. As another example, if the first drive mechanism 26 and the second drive mechanism 28 are different types of drive mechanisms, each driving mechanism 26, 28 may be connected to its own energy source 68.

The apparatus for forging 10 may include a controller 70. The controller 70 may be configured to control the impact velocities $V1_2$, $V2_2$ of the tooling members 14, 16, respectively. For example, the controller 70 may adjust the driving forces $F_1$, $F_2$ applied to the tooling members 14, 16 by the driving mechanisms 26, 28.

The impact velocities $V1_2$, $V2_2$ of one or both of the tooling members 14, 16 and thus, the driving forces $F_1$, $F_2$ generated by one or both of the driving mechanisms 26, 28 may require adjustment based on changes to the forging operation. For example, if the mass $M_1$, $M_2$ of one or both of the tooling members 14, 16 changes, the driving forces $F_1$, $F_2$ required may need to be adjusted in order to achieve the impact velocities $V1_2$, $V2_2$ needed to generate the required impact force $F_I$ for desired deformation of the workpiece 32 and maintain a momentum-balanced system.

One or more sensors 72 may be configured to detect one or more operating conditions of the apparatus for forging 10 and/or the forging process. For example, sensors 72 may detect the velocity of the tooling members 14, 16 (e.g., at the impact position $P2_1$, $P2_2$). As another example, sensors 72 may detect the position of the tooling members 14, 16 throughout the drive stroke and the return stroke. As another example, sensors 72 may detect the magnitude of the impact force $F_I$. As another example, sensors 72 may detect the magnitude of the driving forces $F_1$, $F_2$.

The sensors 72 may be connected to the controller 70. The controller 70 may adjust various operating conditions based upon input provided from the sensors 72. The controller 70 may be automatically controlled by one or more computers implementing computer code or may be manually controlled by an operator.

The resulting impact force $F_I$ generated by the impact of the first tooling member 14 and the second tooling member 16 upon the workpiece 32 may have a magnitude sufficient to deform the workpiece 32 as desired. The impact force $F_I$ may depend on several factors including, but not limited to, the material composition of the workpiece 32, the size of the workpiece 32, the volume of the workpiece 32, the desired deformation (e.g., the change in height and/or width) of the workpiece 32, among other things. For example, the impact force $F_I$ may be determined by the required change in instantaneous height of the workpiece 32 during the forging process, which may correspond to the first distance $d_1$ of the first tooling member 14 between the impact position $P1_2$ and the final position $P1_3$ and the second distance $d_2$ of the second tooling member 16 between the impact position $P2_2$ and the final position $P2_3$.

Those skilled in the art will appreciate that force F may be determined by the following equation:

$$F=ma \quad \text{(Eqn. 3)}$$

wherein, m is the mass of a body and a is acceleration of the body.

Further, acceleration a may be determined by the following equation:

$$a=v^2/2d \quad \text{(Eqn. 4)}$$

wherein, v is the velocity of the body and d is the displacement of the body.

Thus, the impact force $F_I$ may be determined by the following equation:

$$F_I=MV^2/2d \quad \text{(Eqn. 5)}$$

wherein, M is the mass of the tooling member and any components that move with the tooling member, V is the velocity of the tooling member and any components that move with the tooling member, and d is the distance the tooling member travels immediate after impact (e.g., distance between impact position $P_2$ and final position $P_3$).

The driving force F may be determined by the following equation:

$$F=MV^2/2D \quad \text{(Eqn. 6)}$$

wherein, M is the mass of the tooling member and any components that move with the tooling member, V is the velocity of the tooling member and any components that move with the tooling member, and D is the distance the tooling member travels immediate before impact (e.g., distance between initial position $P_1$ and impact position $P_2$).

Thus, given certain operational parameters (e.g., impact force $F_I$, distance $d_1$, $d_2$, distance $D_1$, $D_2$, and/or mass $M_1$, $M_2$ of either tooling member 14, 16 and any components that move with the tooling member), other operational conditions of the apparatus for forging 10 and/or forging process may be determined (e.g., the required impact velocity $V_2$ of either tooling member 14, 16 and any components that move with the tooling member, or the driving force $F_1$, $F_2$) (FIGS. 3-5).

Eqn. 2 may be used to determine the required mass $M_1$, $M_2$ of an opposed tooling member 14, 16 and any components that move with the tooling member and/or the required impact velocity $V_2$ of an opposed tooling member 14, 16 and any components that move with the tooling member in order to maintain a momentum-balanced system and equal impact force $F_I$.

Accordingly, use of the disclosed apparatus and method for momentum-balanced forging may allow for significantly lighter tooling members (e.g., hammer and/or anvil) while still producing substantially similar impact forces during forging of a workpiece.

Figure 9:
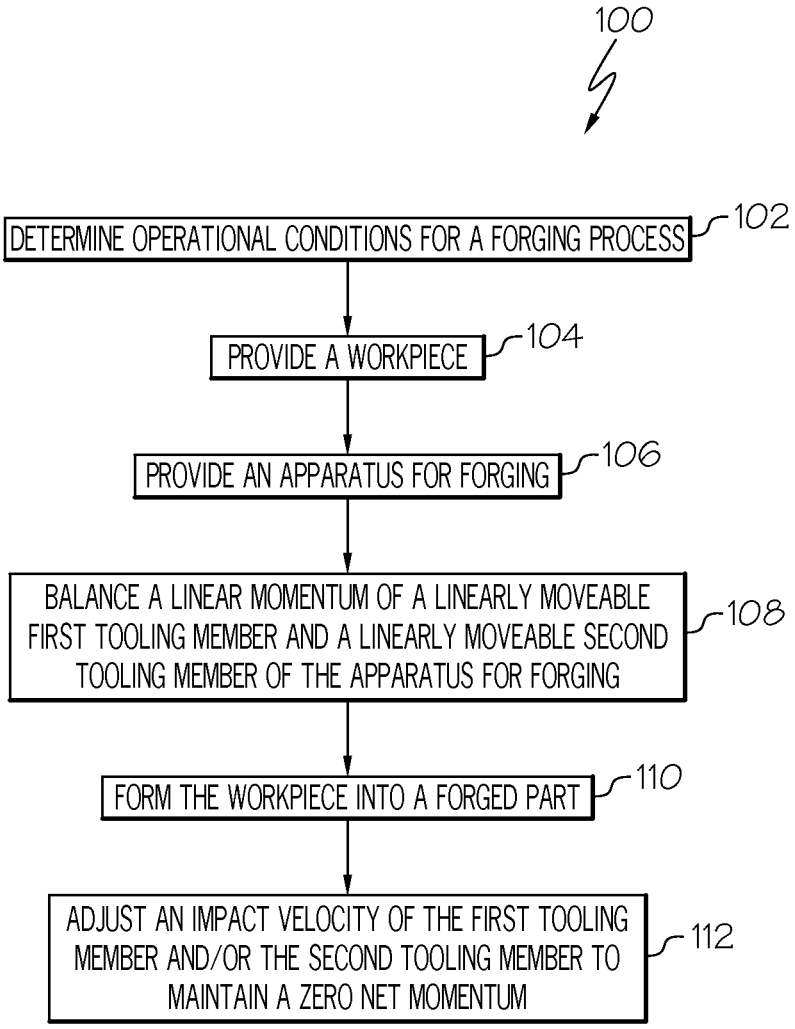
FIG. 9 is a flow diagram depicting an embodiment of the disclosed method for forging.

Referring to FIG. 9, also disclosed is a method, generally designated 100, for momentum-balanced forging. As shown at block 102, the method 100 may begin by determining various operational conditions for a forging process. Examples of operational conditions for the forging process may include the impact force $F_I$ required to deform the workpiece 32, the desired deformation or displacement d of the workpiece 32, available driving forces $F_1$, $F_2$, and the like. Other examples of operational conditions may include the size and geometry of the workpiece 32 to be forged, the accuracy desired, the strength of the workpiece material, the temperature that the workpiece 32 is formed, the desired mechanical properties of the final forged part 34, the sensitivity of the workpiece 32 to strain rate, the amount of forged parts 34 to be produced, the time to produce the forged part 34, and the like.

As shown at block 104, a workpiece 32 may be provided. The workpiece 32 may be any material, such as a metallic material, suitable for forming through the forging process.

As shown at block 106, the apparatus for forging 10 may be provided. The apparatus for forging 10 may include at least the moveable first tooling member 14 configured to form the workpiece 32 upon impact with the workpiece 32 and the moveable second tooling member 16 configured to form the workpiece 32 upon impact with the workpiece 32. The first tooling member 14 and the second tooling member 16 may each be moveable relative to one another (e.g., linearly along the longitudinal axis A of the machine frame 12).

As shown at block 108, a momentum of the first tooling member 14 and the second tooling member 16 may be balanced such that a net momentum of a simultaneous impact with the workpiece by the first tooling member 14 and the second tooling member 16 is minimized (e.g., approximately zero).

As shown at block 110, the workpiece 32 may be formed into a forged part 34 in response to an impact force generated by the simultaneous impact with the workpiece by the first tooling member and the second tooling member.

As shown at block 112, the impact velocities $V2_1$, $V2_2$ of the first tooling member 14 and/or the second tooling member 16, respectively, may be adjusted, such as in response to changes in travel distance due to forging, to maintain approximately zero net momentum. The impact velocities $V2_1$, $V2_2$ of the first tooling member 14 and/or the second tooling member 16, respectively, may be adjusted by modifying the first driving force $F_1$ applied to the first tooling member 14 by the first driving mechanism 26 and/or the second driving force $F_2$ applied to the second tooling member 16 by the second driving member 28.

Figure 10:
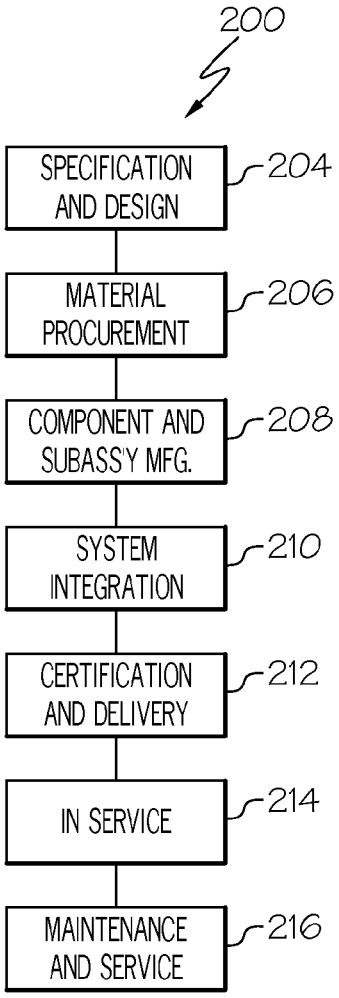
FIG. 10 is a flow diagram of aircraft production and service methodology.
Figure 11:
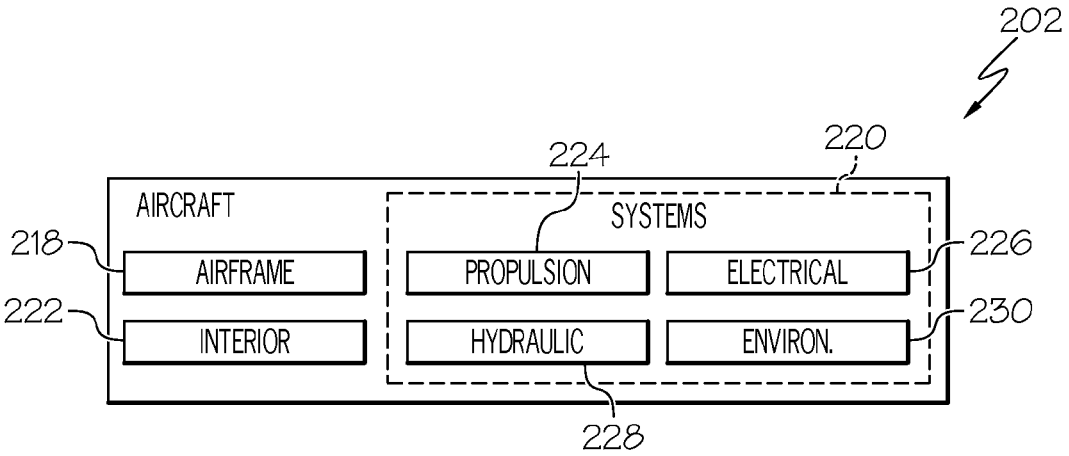
FIG. 11 is a block diagram of an aircraft.

Examples of the disclosure may be described in the context of an aircraft manufacturing and service method 200, as shown in FIG. 10, and an aircraft 202, as shown in FIG. 11. During pre-production, example method 200 may include specification and design 204 of the aircraft 202 and material procurement 206. During production, component and subassembly manufacturing 208 and system integration 210 of the aircraft 202 takes place. Thereafter, the aircraft 202 may go through certification and delivery 212 in order to be placed in service 214. While in service by a customer, the aircraft 202 is scheduled for routine maintenance and service 216, which may also include modification, reconfiguration, refurbishment and the like.

Each of the processes of method 200 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 11, the aircraft 202 produced by example method 200 may include an airframe 218 with a plurality of systems 220 and an interior 222. Examples of high-level systems 220 include one or more of a propulsion system 224, an electrical system 226, a hydraulic system 228, and an environmental system 230. Any number of other systems may be included. Although an aerospace example is shown, the principles of the invention may be applied to other industries, such as the automotive industry.

The disclosed forging apparatus and method may be employed during any one or more of the stages of the production and service method 200. As one example, components or subassemblies corresponding to production process 208 may be fabricated or manufactured using the disclosed forging apparatus and method. As another example, the disclosed forging apparatus and method may be used during the maintenance and service step 216, such as to fabricate or repair components, such as components of the airframe 218 of the aircraft 202. Also, the disclosed forging apparatus and method may be utilized during the production stages 208 and 210, and/or during maintenance and service 216 to substantially expedite the process and/or to reduce overall costs.

Although various embodiments of the disclosed apparatus and method for momentum-balanced forging have been shown and described, modifications may occur to those skilled in the art upon reading the specification. The present application includes such modifications and is limited only by the scope of the claims.

What is claimed is:

1. An apparatus for forging comprising:

a machine frame;

a first tooling member connected to and moveable relative to said machine frame, wherein a workpiece is coupled to and moves with said first tooling member, and wherein:

said first tooling member and said workpiece combine to define a first mass, said first tooling member and said workpiece have a first impact velocity at a first impact position, and said first tooling member and said workpiece have a first momentum at said first impact position;

a second tooling member connected to and moveable relative to said machine frame opposite said first tooling member, wherein:

said second tooling member defines a second mass and has a second impact velocity at a second impact position, said second mass is at most twenty percent of said first mass, and said second tooling member has a second momentum at said second impact position;

a first velocity sensor configured to detect at least said first impact velocity;

a second velocity sensor configured to detect at least said second impact velocity; and a controller configured to adjust at least one of said first impact velocity and second impact velocity such that said second momentum is within twenty percent of said first momentum, wherein:

said second tooling member impacts said workpiece positioned on said first tooling member within an impact zone defined by said first impact position and said second impact position, and a position of said impact zone relative to a first initial position of said first tooling member and a second initial position of said second tooling member is variable.

2. The apparatus of claim 1 wherein said second mass is at most ten percent of said first mass.

3. The apparatus of claim 1 wherein:

said first impact velocity is achieved by applying a first driving force to said first tooling member over a first distance, said second impact velocity is achieved by applying a second driving force to said second tooling member over a second distance, and said first impact velocity is less than said second impact velocity.

4. The apparatus of claim 1 wherein said second mass is at most five percent of said first mass.

5. The apparatus of claim 1 wherein said controller is further configured to adjust at least one of said first impact velocity and second impact velocity such that said second momentum and said first momentum are equal.

6. The apparatus of claim 1 wherein said controller is further configured to adjust at least one of said first impact velocity and second impact velocity such that said second momentum is within ten percent of said first momentum.

7. The apparatus of claim 1 wherein said controller is further configured to adjust at least one of said first impact velocity and second impact velocity such that said second momentum is within five percent of said first momentum.

8. The apparatus of claim 1 wherein said first tooling member comprises a first die and said second tooling member comprises a second die, wherein said workpiece is coupled to said first die, and wherein said first die and said second die are each configured to form said workpiece.

9. The apparatus of claim 3 further comprising:

a first driving mechanism operably connected to said first tooling member, said first driving mechanism being configured to apply said first driving force upon said first tooling member; and a second driving mechanism operably connected to said second tooling member, said second driving mechanism being configured to apply said second driving force upon said second tooling member.

10. The apparatus of claim 9 wherein said first driving mechanism and said second driving mechanism each comprises at least one of a pneumatic drive mechanism, a hydraulic drive mechanism, a combustion drive mechanism, a mechanical drive mechanism, and an electromagnetic drive mechanism.

11. The apparatus of claim 9 further comprising at least one energy source operably connected to said first drive mechanism and said second drive mechanism.

12. The apparatus of claim 1 further comprising at least one position sensor configured to detect at least one of positions of said first tooling member from said first initial position to said first impact position and said second tooling member from said second initial position to said second impact position.

13. The apparatus of claim 9 further wherein said controller is operably connected to said first drive mechanism and said second drive mechanism to control at least one of said first driving force and said second driving force to achieve said first velocity and said second velocity, respectively.

14. The apparatus of claim 1 wherein said first tooling member and said second tooling member travel along a substantially linear path toward one another.

15. The apparatus of claim 1 further comprising at least one force sensor configured to detect a magnitude of an impact force upon said workpiece.

16. An apparatus for forging comprising:

a moveable first tooling member configured to support a workpiece, said first tooling member and said workpiece combine to define a first mass;

a moveable second tooling member configured to form said workpiece upon impact with said workpiece, said second tooling member defines a second mass of at most twenty percent of said first mass;

at least one velocity sensor configured to detect at least one of a first impact velocity of said first tooling member at a first impact position and a second impact velocity of said second tooling member at a second impact position;

a controller configured to move said first tooling member at said first impact velocity and said second tooling member at said second impact velocity relative to one another such that at impact in an impact zone defined by said first impact position of said first tooling member and said second impact position of said second tooling member, a second momentum of said second tooling member is within twenty percent of a first momentum of said first tooling member and said workpiece, wherein a position of said impact zone relative to a first initial position of said first tooling member and a second initial position of said second tooling member is variable.

17. The apparatus of claim 16 wherein said second mass is at most ten percent of said first mass.

18. The apparatus of claim 17 wherein said second mass is at most five percent of said first mass.

19. The apparatus of claim 16 wherein, at said impact, said second momentum is within ten percent of said first momentum.

20. The apparatus of claim 19 wherein, at said impact, said second momentum and said first momentum are equal.

21. A method for forging, said method comprising:

providing a first tooling member and a workpiece supported by said first tooling member, said first tooling member and said workpiece combine to define a first mass and being movable to a first impact velocity at a first impact position;

providing a second tooling member defining a second mass of at most twenty percent of said first mass and movable to a second impact velocity at a second impact position, said first tooling member and said second tooling member each being moveable relative to one another;

detecting at least one of said first impact velocity of said first tooling member at said first impact position and said second impact velocity of said second tooling member at said second impact position;

controlling said first impact velocity and said second impact velocity such that a second momentum of said second tooling member at said second impact position is within twenty percent of a first momentum of said first tooling member and said workpiece at said first impact position;

forming said workpiece in response to an impact force generated by an impact, in an impact zone defined by said first impact position and said second impact position, between said first tooling member and said workpiece and said second tooling member; and varying a position of said impact zone relative to a first initial position of said first tooling member and a second initial position of said second tooling member.

22. The method of claim 21 wherein said first tooling member and said second tooling member both move in a linear path.

23. The method of claim 21 further comprising controlling said first velocity and said second velocity such that said second momentum is within ten percent of said first momentum.

24. The method of claim 23 further comprising controlling said first velocity and said second velocity such that said second momentum and said first momentum are equal.

25. The method of claim 21 wherein said second mass is at most ten percent of said first mass.

* * * * *